United States Patent [19]

Haraden et al.

[11] Patent Number: 4,485,331

[45] Date of Patent: Nov. 27, 1984

[54] FLUORESCENT LAMP HOLDER

[75] Inventors: Thomas Haraden, Ipswich; Harold L. Hough, Beverly, both of Mass.

[73] Assignee: GTE Products Corporation, Stamford, Conn.

[21] Appl. No.: 329,907

[22] Filed: Dec. 11, 1981

[51] Int. Cl.[3] ..... H01J 7/44

[52] U.S. Cl. ..... 315/57; 315/58; 339/6 R; 362/362

[58] Field of Search ..... 313/49, 318, 324; 339/1 L, 2 A, 2 L, 6 R, 6 A, 8 PS, 68, 112 R; 362/362, 370, 373, 410, 412, 413, 414, 417, 418, 216; 315/53, 57, 58; 336/55, 59; D26/42, 93

[56] References Cited

U.S. PATENT DOCUMENTS

| | | | |
|---|---|---|---|
| 4,146,112 | 3/1979 | Usry | 336/59 |
| 4,375,607 | 3/1983 | Morton et al. | 315/56 |
| 4,389,595 | 6/1983 | Kamei et al. | 315/57 |

*Primary Examiner*—John D. Lee
*Assistant Examiner*—Robert E. Wise
*Attorney, Agent, or Firm*—William H. McNeill

[57] ABSTRACT

A lamp holder and ballast containing assembly has a body provided with cooling louvers. Internally positioned baffle plates are associated with the louvers and serve to position a transformer while at the same time protecting the winding thereof.

2 Claims, 4 Drawing Figures

FLUORESCENT LAMP HOLDER

TECHNICAL FIELD

This invention relates to fluorescent lamp holders and more particularly to such holders which include a ballast and are suited for use with incandescent fixtures.

BACKGROUND ART

Because of the increasing cost of electrical energy, the substitution of initially costlier, but more energy efficient, fluorescent lamps in place of incandescent lamps has become practical. A prime candidate for this substitution is the circular fluorescent lamp primarily because of its compact size when compared with the more typical elongated fluorescent lamp.

Common to most structures employed for this purpose are a central hub which includes a ballast and one or more arms or similar constructions projecting from the hub for holding the lamp.

Exemplary devices of this type are shown in U.S. Pat. Nos. 2,298,961; 2,817,004; Des. 259,961; and 4,278,911.

When the ballast includes a transformer, it is desirable that efficient cooling means be provided to dissipate the heat generated by the transformer. It would also be advantageous to provide means for adequately protecting the transformer. These features are absent from the prior art.

DISCLOSURE OF THE INVENTION

It is, therefore, an object of the invention to obviate the disadvantages of the prior art.

It is another object of the invention to provide an enhanced lighting unit.

These objects are accomplished, in one aspect of the invention, by the provision of a lamp holder and ballast containing assembly which includes a central, hollow body for containing a ballast. The body includes a plurality of cooling louvers having internal baffles associated therewith. The louvers dissipate heat generated by the ballast while the baffles protect the ballast from intrusion of foreign objects through the louvers.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 2:
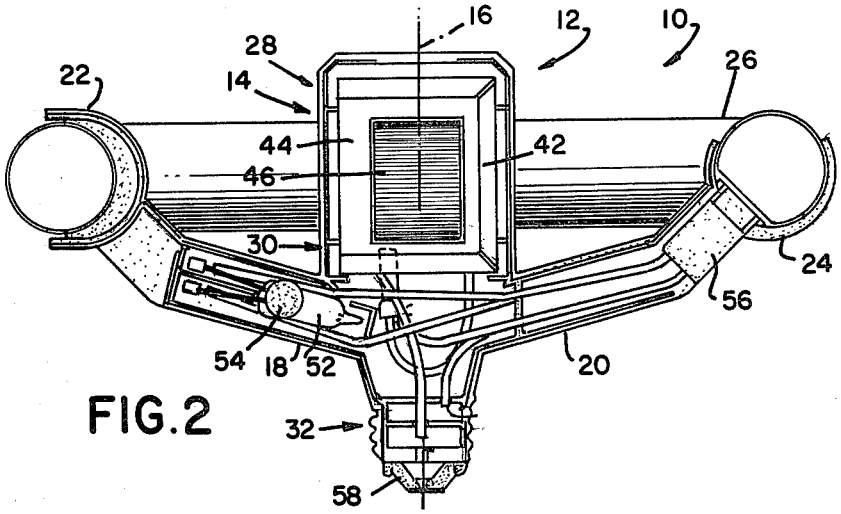
FIG. 2 is a sectional, elevational view taken along the line 2—2 of FIG. 1.
Figure 1:
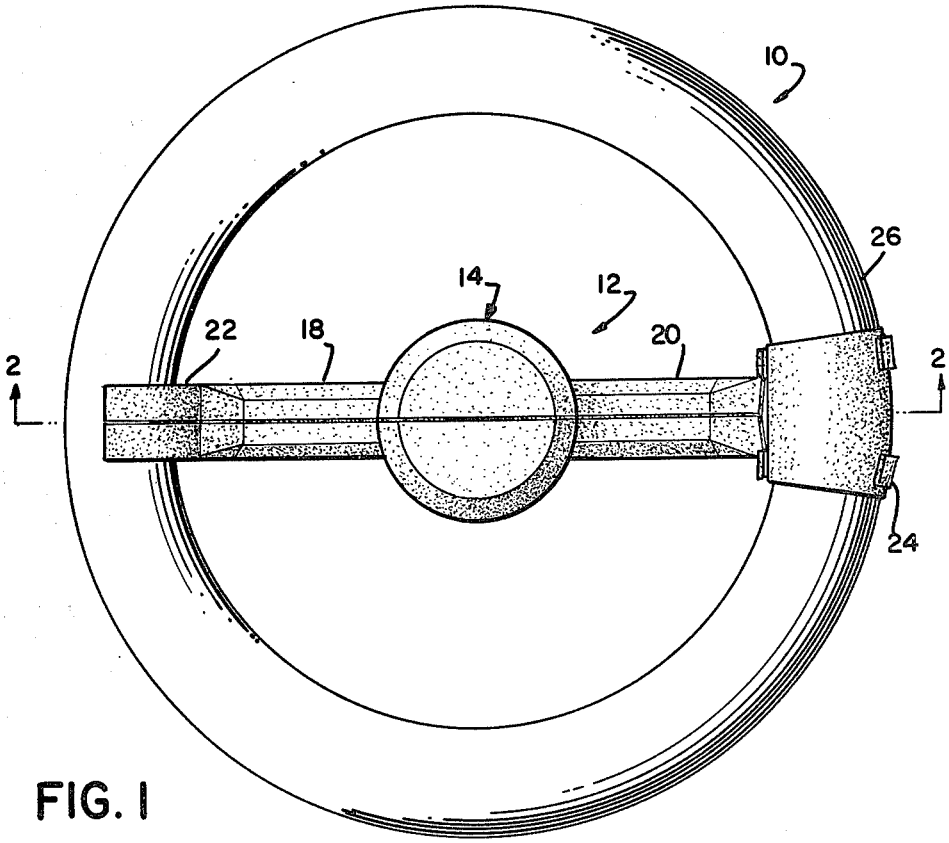
FIG. 1 is a plan view of the lamp holder of the invention.

Referring now to the drawings with greater particularity, there is shown in FIG. 1 a lamp holder and ballast containing assembly 10 which comprises a housing 12 having a central, hollow body 14 disposed about a longitudinal axis 16. Diametrically opposed arms 18 and 20 project from the housing 12 and terminate in lamp receiving means 22 and 24 for a circular lamp 26.

Figure 3:
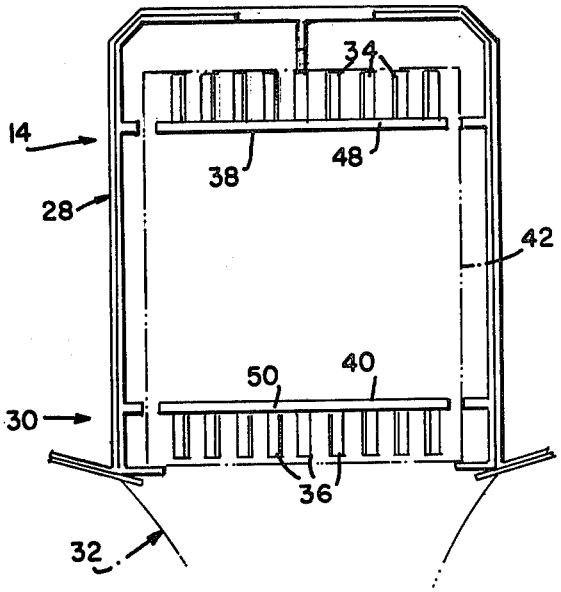
FIG. 3 is an enlarged, elevational detail similar to FIG. 2 with parts shown in phantom.
Figure 4:
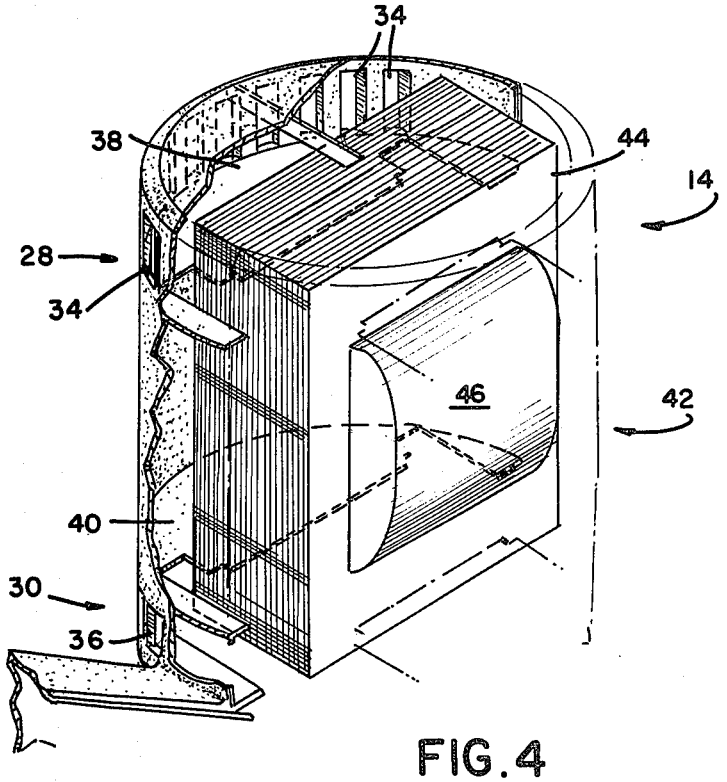
FIG. 4 is a partial, perspective view of the invention.

The body 14 has an upper portion 28, an intermediate portion 30 and a lower portion 32. A plurality of cooling louvers 34 is peripherally arrayed about the upper portion 28 and similar cooling louvers 36 and arrayed about the intermediate portion 30 (See FIGS. 3 and 4).

Associated with louvers 34 is an integral first baffle plate 38 which is formed on the interior surface of body 14. The first baffle plate 38 is positioned below the louvers 34 and extends inwardly of body 14 toward the longitudinal axis 16.

A second baffle plate 40 is associated with louvers 36, but is positioned above these louvers.

A ballast transformer 42 comprised of peripheral core laminations 44 and a centrally disposed winding 46 is positioned within body 14 so that the winding 46 is between the first and second baffle plates 38 and 40. The interior edges 48 and 50 respectively of the baffle plates abut the core laminations 44 and hold the transformer in position in body 14.

The body 14 is formed in two mirror image halves so that the transformer 42 is held in place from two sides.

The remaining parts of the ballast, such as the glow-bottle 52 and capacitor 54, as well as the lamp connecting plug 56 and all associated wiring are contained within the remainder of hollow body 14 and the arms 18 and 20 which also are hollow.

When the ballast components are placed in position in one of the body halves, the other body half is placed thereover and affixed thereto, as by cementing.

A suitable base 58 is provided on lower portion 32, such as a typical screw-in base, and the appropriate electrical connections are made thereto.

The completed assembly thus is provided with adequate cooling means in the form of the louvers 34 and 36 which communicate from the interior of body 14 to the exterior thereof, while the internally associated baffle plates 38 and 40 protect the coil winding 46 from the intrusion of foreign objects through the louvers.

While there have been shown what are at present considered to be the preferred embodiments of the invention, it will be apparent to those skilled in the art that various changes and modifications can be made herein without departing from the scope of the invention as defined by the appended claims.

We claim:

1. A lamp holder and ballast containing assembly comprising: a housing having a central, hollow body disposed about a longitudinal axis, said body having an upper portion, an intermediate portion and a lower portion; a plurality of cooling louvers peripherally arrayed about said upper portion and said intermediate portion; and integral first and second baffle plates formed on the interior wall of said housing extending toward said longitudinal axis, said first baffle plates being associated with said louvers of said upper portion and said second baffle plates being associated with said louvers of said intermediate portion.

2. The assembly of claim 1 wherein said ballast includes a transformer having peripheral core laminations and centrally disposed windings; said first and second baffles mounting and positioning said transformer and engaging said laminations, said baffles being disposed between the louvers and the transformer, thereby presenting a shield preventing objects inserted through the louvers from touching said centrally disposed windings.

* * * * *